US005235900A

United States Patent [19]

Garceau

[11] Patent Number: 5,235,900

[45] Date of Patent: Aug. 17, 1993

[54] ROTARY ACTUATOR DEVICE HAVING AN ANNULAR PISTON ROD

[75] Inventor: Patrick Garceau, St Marcel, France

[73] Assignee: Societe Europeenne de Propulsion, Suresnes, France

[21] Appl. No.: 809,343

[22] Filed: Dec. 18, 1991

[30] Foreign Application Priority Data

Dec. 28, 1990 [FR] France ..... 90 16512

[51] Int. Cl.[5] ..... F01C 9/00

[52] U.S. Cl. ..... 92/120; 92/123; 92/125; 92/187; 92/188; 92/240; 92/241; 92/246

[58] Field of Search ..... 72/120, 123, 125, 187, 72/188, 240, 241, 246

[56] References Cited

U.S. PATENT DOCUMENTS

| | | | |
|---|---|---|---|
| 312,495 | 2/1885 | Nash | 92/187 X |
| 1,616,310 | 2/1927 | Esnault-Pelterie | 92/246 |
| 3,173,344 | 3/1965 | Mongitore | 92/120 X |
| 3,295,419 | 1/1967 | Vielmo et al. | 92/241 |
| 3,731,597 | 5/1973 | Payne | 92/120 |
| 4,724,743 | 2/1988 | Eickmann | 92/187 X |

FOREIGN PATENT DOCUMENTS

| | | | |
|---|---|---|---|
| 0181971 | 5/1986 | European Pat. Off. . | |
| 2345607 | 9/1980 | France . | |
| 61145 | 7/1939 | Norway | 92/240 |
| 43396 | 5/1915 | Sweden | 92/240 |
| 1456614 | 11/1976 | United Kingdom | 92/120 |
| 1518061 | 7/1978 | United Kingdom . | |
| 2217181 | 10/1989 | United Kingdom . | |

*Primary Examiner*—Edward K. Look
*Assistant Examiner*—Todd Mattingly
*Attorney, Agent, or Firm*—Weingarten, Schurgin, Gagnebin & Hayes

[57] ABSTRACT

A rotary actuator device having an annular piston rod, the device comprising at least one piston held provided with sealing means and co-operating with an annular piston rod mounted so as to be capable of moving in an annular chamber, together with means for selectively applying a fluid under pressure in said annular chamber, wherein the piston head co-operates with the piston rod via a hinge having one degree of freedom in rotation and one degree of freedom in translation, said hinge comprising a piece in the form of a knife whose edge co-operates with a V-groove in a female portion of triangular profile, the knife edge and the V-groove being parallel to the axis of rotation of the piston rod. This disposition enables the forces exerted on the sealing means to be brought back into balance, thereby increasing sealing even under high pressures.

12 Claims, 2 Drawing Sheets

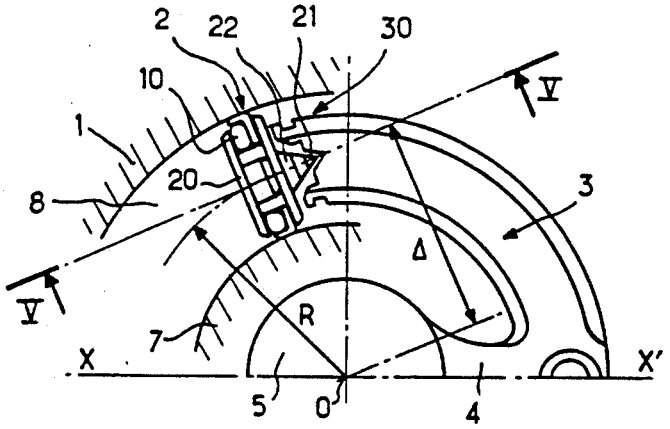
FIG. 1
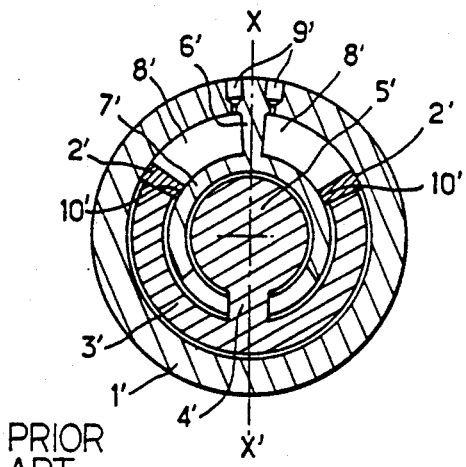
FIG. 2
FIG. 3
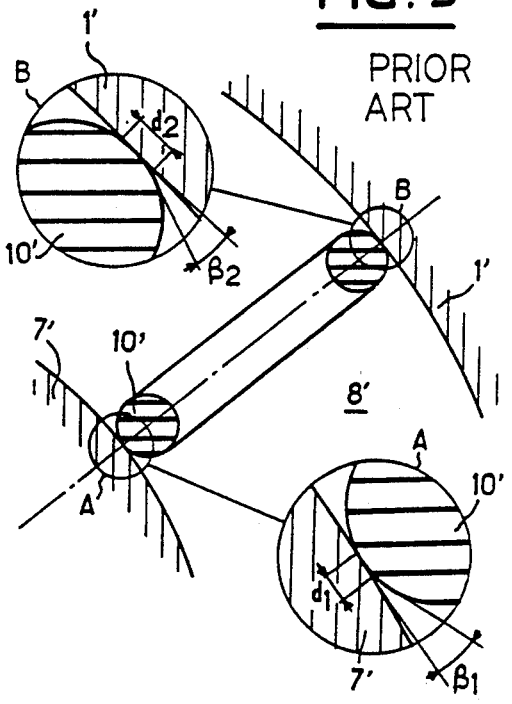
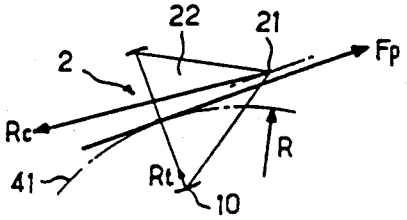
FIG. 4

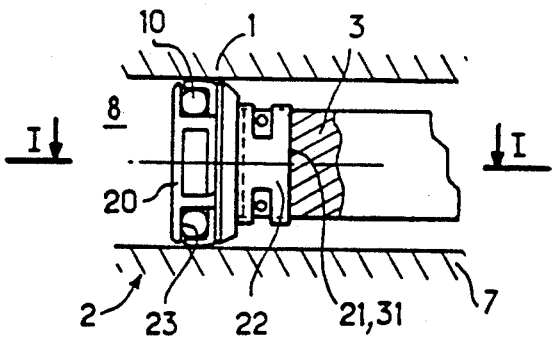
FIG. 5
FIG. 6
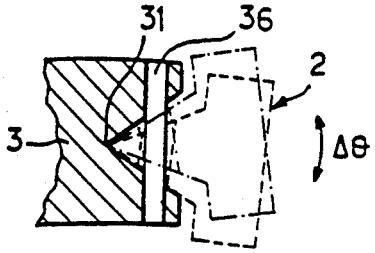
FIG. 7
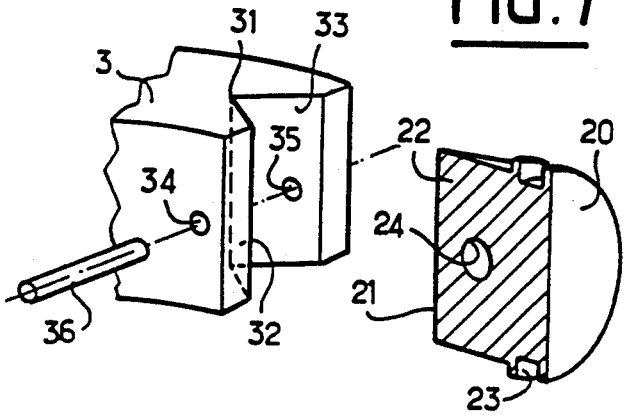
FIG. 8
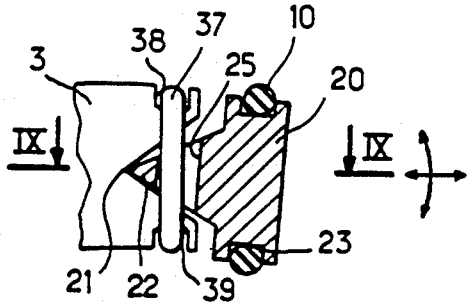
FIG. 9
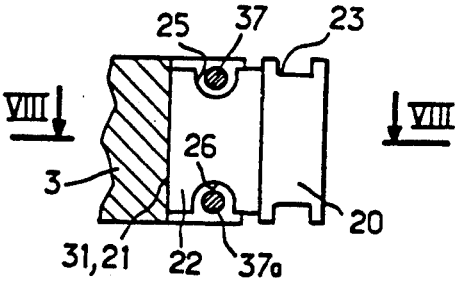
FIG. 10
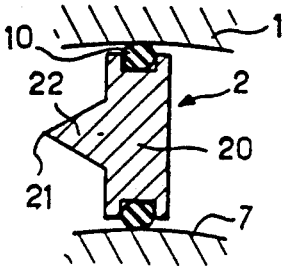
FIG. 11
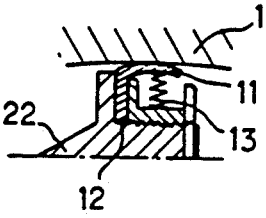
FIG. 12
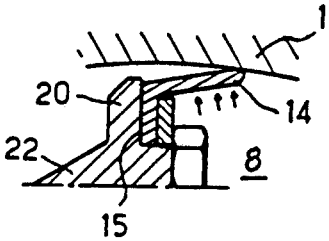

ROTARY ACTUATOR DEVICE HAVING AN ANNULAR PISTON ROD

FIELD OF THE INVENTION

The present invention relates to a rotary actuator device having an annular piston rod, the device comprising at least one piston head provided with sealing means and co-operating with an annular piston rod mounted in such a manner as to be capable of moving in an annular chamber, together with means for selectively applying a fluid under pressure in said annular chamber.

The invention relates more particularly to "high performance" rotary actuators having a toroidal-shaped chamber for use in medium and high pressure hydraulic and pneumatic applications, e.g. with pressures of about $100\times10^5$ pascals.

PRIOR ART

Rotary actuator devices having an annular piston rod caused to move under drive from fluid pressure are already known, in particular from Document U.S. Pat. No. 3,446,120.

Accompanying FIG. 2 is a diagram of one such type of rotary actuator having a toroidal chamber which makes it possible to produce torque directly (i.e. without using a motion-transforming mechanism) like a vane actuator, while still being similar to a linear actuator with respect to sealing functions.

The rotary actuator shown in FIG. 2 comprises an actuator rod 3' that is toroidal in shape and that is connected by a radial link 4' to a central shaft 5', thereby defining a kind of anchor shape. The free ends of the actuator rod 3' are provided with respective piston heads 2' themselves provided with sealing means such as 0-rings 10' The piston 2', 3' moves in a toroidal chamber 8' delimited by an outer body 1' and an inner wall 7' itself connected to the outer body by a radial connection 6' in the vicinity of which pneumatic or hydraulic fluid pressure can be applied to the annular chamber 8' adjacent to one or other of the piston heads 2' via orifices 9' formed through the outer body 1'.

By construction, the actuator rod 3' is curved to enable it to move inside the chamber 8' with all of its points rotating about substantially the same radius. As a result the actuator rod 3' is subjected to bending rather than to traction/compression as is the case in a linear actuator.

The existence of bending moment which is inherent to the very principle on which this type of member is based, is accompanied by the end 2' of the rod 3' deforming during stages where it receives and transmits the force generated by the pressure on the piston. This deformation which is exerted transversely to the displacement of the piston within the chamber 8' hinders obtaining high performance and reduces the reliability of sealing insofar as it is transmitted totally or in part to the piston head 2' carrying the sealing ring 10'.

For a given actuator, the amplitude of the deformation is proportional to the operating pressure, and the resulting limitation may come either from the stress on the rod 3' and the shaft 5' which generally constitute a rigid assembly, sometimes in a single piece, or else from the inability of the sealing ring 10' to absorb the deformation.

The difficulty in obtaining adequate sealing at the piston head 2' of a rotary actuator having an annular piston rod will be better understood with reference to FIG. 3 which shows the relative positions of an O-ring 10' on a piston head 2' in a rotary actuator, and the walls of the toroidal chamber 8' defined by the parts 1' and 7'.

Because of the curvature of the torus in which the piston moves to produce motion, the configuration of the contact between the sealing device (sealing ring 10') and the surface of the torus defining the chamber 8' passes smoothly from convex -convex (zone A) on the inside generator line to convex -concave (zone B) on the outside generator line.

As a result of this asymmetry:

a) firstly the configuration of the zone A has a contact width d1 between the sealing ring and the torus which is smaller than the contact width d2 between the sealing ring and the torus in the configuration of zone B; and b) secondly the angle of attack $\beta 1$ between the tangents at the margin of the contact is greater in zone A, other things being equal, than the angle of attack $\beta 2$ between the tangents at the margin of the contact in zone B.

These two local parameters d and $\beta$ have a considerable effect on sealing performance (static and dynamic in the first case, essentially dynamic in the second), i.e. when the actuator is moving, sealing is enhanced in zone A and reduced in zone B relative to the "neutral" configuration obtained on a mean generator line.

To this state of affairs, it is necessary to add the above-described. This phenomenon makes things worse with regard to the force induced by the mechanical deformation of the anchor shape 3' which is transmitted to the O-ring in the form of an outwardly directed radial resultant.

This effect affects both static sealing and dynamic sealing. It is particularly troublesome during sudden rises in pressure, given the moderate "response" time of most conventional O-rings (where the time constant depends on the technology and on the material from which the O-ring is made).

Finally, it should be recalled that at high displacement velocities, the additional effect of centrifugal force on the moving parts further degrades sealing conditions and is thus capable of putting a limit on the dynamic performance of the actuator.

Attempts have already been made to limit the deformation of the actuator rod 2', e.g. as in the embodiment described in Document FR-A-2 345 607. Nevertheless, that leads to structures that are complex and difficult to develop.

In the majority of known embodiments for industrial applications (uncleaned air, at a pressure of about $10^6$ pascals, max.), attempts have been made to establish a degree of freedom between the piston 2' and the rod 3' to enable the piston 2' to position itself automatically within the chamber 8', and also to facilitate assembly.

These degrees of freedom seek to decouple the functions of guiding the piston 2' and of transmitting force so that they do not interfere with the sealing function. This problem is not very critical in low pressure applications, but it becomes a major problem at higher pressures because of the mechanical forces involved, given the selection it imposes on the technology used for sealing.

This concept which is most promising with respect to performance, capacity, and reliability has been difficult to extend to higher temperature and pressure applications mainly because of the inadequacies of the technical solutions that have been used heretofore.

OBJECT AND SUMMARY OF THE INVENTION

The invention seeks to provide a rotary actuator device having an annular piston that enables the above-mentioned drawbacks to be remedied, and in particular that can guarantee good sealing at the piston heads even in relatively high pressure ranges, e.g. about $70\times10^5$ pascals to about $100\times10^5$ pascals, under temperature conditions that may be cryogen e.g. less than about 150 K, and in association with fluids that are highly volatile, such as cold gaseous helium.

Another object of the invention is to provide a rotary actuator device having an annular piston rod in which the natural deformation of the parts that transmit the drive couple acts beneficially with respect to sealing, efficiency, and endurance.

Another object of the invention consists in optimizing friction in a toroidal actuator and in the absence of any lubrication in the toroidal chamber.

These objects are achieved by a rotary actuator device having an annular piston rod, the device comprising at least one piston head provided with sealing means and co-operating with an annular piston rod mounted so as to be capable of moving in an annular chamber, together with means for selectively applying a fluid under pressure in said annular chamber, the device being characterized in that the piston head co-operates with the piston rod via a hinge having one degree of freedom in rotation and one degree of freedom in translation, said hinge comprising a piece in the form of a knife whose edge co-operates with a V-groove in a female portion of triangular profile, the knife edge and the V-groove being parallel to the axis of rotation of the piston rod.

The distance between the knife edge and the axis of rotation of the piston rod is determined as a function of the deformation under load to compensate for the radial force exerted on the piston rod, or else to undercompensate or overcompensate slightly, for the purpose of ensuring sealing around the entire periphery of the sealing means.

Because of the "knife edge" type connection between the piston head and the piston rod with the edges being positioned on an axis parallel to the axis of rotation of the actuator, the piston head can constitute a genuine pivoting sealing head having two degrees of freedom that tend naturally to reinforce the sealing where it is normally least effective, i.e. on the inside of the toroidal chamber.

The distance between the knife edge carried by the rod and the axis of rotation is determined so that a small tilting couple is generated in operation to produce a residual radial force on the sealing head that acts towards the inside.

The way this force is adjusted takes account essentially of two parameters for the purpose of compensating them:

the angular velocity which produces a centrifugal force on the sealing head; and the convex -convex configuration between the sealing surface of the sealing means and the inside surface of the torus which, to ensure sealing, requires a contact pressure that is slightly greater than that required in the outer zone where the centers of curvature are both on the same side of the contact zone.

In a particular embodiment, the knife is an integral portion of the piston head and said female portion of triangular profile is formed at the end of the piston rod.

Said female portion of triangular profile opens out by an angle that is substantially greater than the angle at the apex of the knife which is also of triangular section, thereby providing the degree of freedom in rotation. Preferably, the device includes fastening means disposed between the piston head and the piston rod to prevent the piston head coming apart from the piston rod on which it is hinged.

While still allowing the piston head carrying the sealing means two degrees of freedom, the fastening means make it possible to avoid any risk of disconnection or relative rotation between the piston head and the piston rod, even when the piston rod is driven by hand, for example.

In a first particular embodiment, said fastening means comprise a pin passing through the knife and the female portion of triangular profile perpendicularly to said edge.

In a second particular embodiment, said fastening means comprise at least one clip extending essentially perpendicularly to said knife edge, said clip being engaged in grooves formed in the knife and having curved ends themselves engaged in notches formed in the support of the female portion of the triangular profile.

The sealing means disposed on the piston head may comprise a sealing gasket having spherical contact whose radial stiffness is chosen as a function of the operating pressure in the annular chamber.

A similar solution is the conventional sealing solution using a toroidal gasket of the O-ring type, made of elastomer and suitable for use in ordinary applications.

In another embodiment, said sealing means comprise a gasket having a lip, a bead, and an expander for providing automatic mechanical centering.

In yet another embodiment, the sealing means comprise a gasket having a lip and a bead with the autoclave effect providing pneumatic stiffness.

The above two embodiments correspond to high performance solutions particularly adapted to use under high pressure or in the cryogenic field.

The above two embodiments which are particularly advantageous when used in combination with a knife edge type hinge of the type mentioned above are also particularly adapted to proportional control and to regulating any type of fluid, including a cryogenic fluid, because of the excellent performance that optimizes sealing while limiting friction.

In general, compared with prior art embodiments used over a range of operating pressures that does not exceed $10^6$ pascals, the actuator of the invention not only makes it possible to extend the operating range, e.g. up to pressure that may easily be about $10^7$ pascals, but also contributes to improve the "torque per unit mass" parameter which may rise, for example, from 15 Nm/kg to 30 Nm/kg, with the corresponding volume being ten times smaller.

The invention is applicable to medium or high pressure actuators, regardless of whether they are of the pneumatic type or of the hydraulic type.

BRIEF DESCRIPTION OF THE DRAWINGS

Other characteristics and advantages of the invention appear from the following description of particular embodiments, given by way of non-limiting example and with reference to the accompanying drawings, in which:

FIG. 1 is a half section view on a midplane perpendicular to the axis of rotation and line I—I of FIG. 5, showing a pivoting head rotary actuator device of the invention;

FIG. 2 is a section on a midplane perpendicular to the axis of rotation through a prior art rotary actuator device having an annular piston rod;

FIG. 3 is a detail section view on a midplane perpendicular to the axis of rotation showing the contacts between an O-ring of a piston head in a rotary actuator device such as that shown in FIG. 2 and the walls of the toroidal chamber in which the piston head moves;

FIG. 4 is a vector diagram of the forces exerted via a pivoting head of an actuator device of the invention;

FIG. 5 is a section view on line V—V of FIG. 1;

FIG. 6 is a section view through the end of the piston rod of a device of the invention perpendicular to its pivot edges, showing a first way of assembling the piston head to the piston rod;

FIG. 7 is an exploded perspective view showing the FIG. 6 way of assembling the piston head to the piston rod;

FIG. 8 is a section view on line VIII—VIII of FIG. 9 through the piston head and the end of the piston rod of a device of the invention on a plane perpendicular to the pivot edges, showing a second way of assembling the piston head to the piston rod;

FIG. 9 is a section view on line IX—IX of FIG. 8;

FIG. 10 is a section view of a knife edge pivoting piston head of the invention provided with an O-ring, the section being on a plane perpendicular to the knife edge;

FIG. 11 is a half-section likewise perpendicular to the knife edge, through a pivoting piston head of the invention provided with a gasket having a lip and a bead, together with an expander that provides automatic mechanical centering; and FIG. 12 is a half-section perpendicular to the knife edge through a pivoting piston head of the invention provided with a gasket having a lip and a bead, and providing an autoclave effect that ensures pneumatic stiffness.

DETAILED DESCRIPTION OF PARTICULAR EMBODIMENTS

FIG. 1 shows a portion of a hydraulic or pneumatic rotary actuator device having a toroidal chamber 8 and in accordance with the invention, which device may be symmetrical about a plane X'X, as is the case of conventional actuators of the type shown in FIG. 2.

The actuator of FIG. 1 essentially comprises an annular piston rod 3 connected by a radial connection portion 4 to a central shaft 5 which can thus be directly rotated from a pressure applied in the toroidal chamber 8 without there being any additional mechanical member for transforming motion. By providing a piston rod 3 with a piston head 2 at each of its two free ends as shown in FIG. 2 it is possible to drive the shaft 5 selectively in one direction or the other. The toroidal chamber 8 may be made as a single piece, as in the prior art embodiment shown in FIG. 2, and it is delimited by an outer body 1 and an inner portion 7, which meet on a mean generator line of the torus.

The actuator of FIG. 1 differs from that shown in FIG. 2 essentially in that the piston head 2 on which the pressure of the fluid applied to the chamber 8 is exerted, which head is provided with sealing means 10, e.g. constituted by a conventional O-ring made of elastomer, is neither fixed rigidly to the end of the anchor-shaped piston rod 3, nor is it merely in contact via a plane radial surface with the end face of the piston rod 3.

On the contrary, as shown in FIGS. 1 and 5, the piston head 2 co-operates with the piston rod 3 via a special hinge having one degree of freedom in rotation about an axis parallel to the axis of rotation 0 of the piston 3 of the actuator, and one degree of freedom in translation along said parallel axis which is embodied firstly by an edge 21 of a male portion 22 in the form of a knife secured to the sealing head 2, and secondly by a V-groove 31 in a triangular-profile female portion formed at the end of the piston rod 3.

The knife-forming male portion 22 may be integral with the body 20 of the piston head 2. As can be seen in FIGS. 6 to 8, the knife-forming portion 22 may have an angle at its knife edge which is substantially smaller than the opening angle of the triangular section female portion defined by the two faces 32 and 33 and the V-groove 31 at the end of the piston rod 3, specifically to provide a degree of freedom in rotation through an angle $\Delta\theta$ about the axis defined by the edges 21 and 31 which are in contact with each other.

To prevent the piston head 2 becoming disconnected from the piston rod 3, e.g. in the event of the piston rod 2 being manually actuated from the shaft 5, fastening means are provided that ensure that the edge 21 and the groove 31 remain in contact to form the hinge of the pivoting head 2 on the piston rod 3, but without interfering with the movements of the piston head 2 in the above-mentioned two degrees of freedom.

In a first possible embodiment, as shown in FIGS. 6 and 7, the fastening means comprise a pin 36 which passes through the knife 22 and through the triangular profile female portion 32, 33 perpendicularly to the edge 21 and the groove 31. The orifice 24 provided through the knife 22 for receiving the pin 36 provides greater clearance than do the orifices 34 and 35 formed through the walls delimiting the faces 32 and 33 of the female portion that receives the knife 22, thereby leaving the knife 22 free to rotate about the axes 21, 31 in operation.

In another embodiment, as shown in FIGS. 8 and 9, the fastening means comprise two clips 37 and 37*a* extending perpendicularly to the knife edge 21. Each clip 37, 37*a* is engaged with a relatively large amount of clearance in a corresponding groove 25, 26 formed in the small side faces of the knife 22. The clips 37, 37*a* have curved ends engaged in notches 38, 39 formed in the outside portions of the piston rod 3. The clearance in the grooves 25, 26 is large enough to avoid impeding motion of the knife 22 about the edges 21, 31.

In a particular embodiment, shown in FIGS. 1 and 5 to 10, the body 20 of the piston head 2 includes an annular groove 23 in which a conventional elastomer O-ring 10 is received, which ring is well suited to common applications, i.e. to ordinary pressure and to non-cryogenic temperatures.

FIGS. 11 and 12 show two other embodiments of sealing devices that are particularly adapted to occasions when high performance is required, for example for cryogenic applications down to temperatures of about −200° C. and for high pressures such as pressures of 107 pascals obtained with a very leak-prone gas such as helium.

The embodiments shown in FIGS. 11 and 12 provide excellent sealing with little friction, thereby making them particularly adapted to proportional control and to regulation.

In FIGS. 11 and 12, there can be seen gaskets having a lip 11, 14 and a bead 12, 15 constituted by polymer envelopes of a profile adapted to specified operating conditions and making use either of resilient expanders 13 (FIG. 11) to provide automatic mechanical centering, or else of the autoclave effect of the pressure (FIG. 12) to generate and control the contact force so that it is just sufficient to ensure sealing.

In general, the sealing head 2 is provided with a gasket having a high degree of resilient restitution and whose stiffness in operation is designed so that a contact force which ensures sealing is obtained at all points, taking account of any possible residual radial force.

As shown in FIG. 12, the autoclave effect of the gasket 14, 15 contributes to sealing by adding pneumatic stiffness proportional to pressure.

In practice, a contact force between the gasket and the torus generating a local contact pressure lying in the range two times to three times the operating pressure in the toroidal chamber 8 of the actuator constitutes a criterion for obtaining satisfactory sealing.

It is particularly important to implement a piston head 2 hinged to the piston rod 3 via a connection having two degrees of freedom of the knife-edge type, having a hinge axis parallel to the axis of rotation of the actuator and perpendicular to the midplane of the toroidal chamber 8, since it enables the forces applied to the various portions of the gasket 10, 11 to 13 or 14, 15 to be brought back into equilibrium, and in particular it enables sealing to be reinforced in the portion adjacent to the inside generator line of the torus, and it enables the negative effects of the prior art devices as explained above with reference to FIG. 3 to be compensated.

As can be seen in FIG. 4, the distance between the knife edge 21 and the axis of rotation O of the actuator may be different from the radius R of the midline 4' of the torus, and it is determined as a function of the deformations that occur under load so that the reaction force Rc compensates or even cancels the radial force Rsigma exerted on the inner portion of the sealing head 2 and due to the force exerted by the fluid pressure on the sealing head 2.

The distance between the knife edge 21 and thus also the corresponding V-groove 31 carried by the rod 3, and the axis of rotation O of the actuator is thus determined in such a manner that a small tilting torque is generated in operation to produce a residual radial force on the sealing head 2, which residual force acts inwards.

This compensating residual radial compensating force is adjusted by taking account essentially of the following two parameters:

angular velocity which produces a centrifugal force on the sealing head 2; and the convex -convex configuration between the sealing lip 11, 14 or the spherical contact of the gasket 10 and the inside face of the wall 7 of the toroidal chamber 8, which to provide sealing requires a contact pressure that is slightly greater than that required in the outer zone where the centers of curvature lie on the same side of the contact.

Because of the compensations provided by the particular configuration of the connection between the piston head 2 and the piston rod 3, radial displacements at the gasket 10 can be reduced to strokes of about 5/100-ths of a millimeter, for example, thereby making it possible with presently existing gaskets to guarantee good sealing even at high pressures. In addition, by limiting the interfering forces induced on the piston rod 3, the lifetime of the gaskets can be increased.

The above description relates to a connection between a knife 22 secured to the body 20 of the piston head 2 and a more widely open re-entrant triangular-profile portion at the free end of the piston rod 3. In some cases, the positions of the knife 22 and of the female portion 32, 33 may nevertheless be swapped over, with the female portion being formed on the piston head and the knife itself being formed at the end of the rod 3.

By way of example, an actuator of the invention may be about 115 mm to 120 mm in diameter, about 75 mm in axial extent, and its mass may be about 2 kg, with the actuator being capable of providing a torque of about 150 Nm, for example. Actuators of the invention can thus be very compact while providing improved performance and reliability.

I claim:

1. A rotary actuator device having an annular piston rod, the device comprising at least one piston head provided with sealing means and co-operating with an annular piston rod mounted for moving in and sealing an annular chamber, together with means for selectively applying a fluid under pressure in said annular chamber, wherein the piston head cooperates with the piston rod via a hinge having one degree of freedom in rotation and one degree of freedom in translation, said hinge comprising a piece in the form of a knife whose edge co-operates with a V-groove in a female portion of triangular profile, the knife edge and the V-groove being parallel to the axis of rotation of the piston rod, wherein the distance between the knife edge and the axis of rotation of the piston rod is determined as a function of deformation under load to compensate the radial force exerted on the piston rod.

2. A device according to claim 1, wherein the knife is an integral portion of the piston head and said female portion of triangular profile is formed at the end of the piston rod.

3. A device according to claim 1, wherein the knife is secured to the end of the piston rod and said female portion of triangular profile is formed in the piston head.

4. A device according to claim 1, wherein said female portion of triangular profile opens out by an angle that is substantially greater than the angle at the apex of the knife which is also of triangular section, thereby providing the degree of freedom in rotation.

5. A device according to claim 1, including fastening means disposed between the piston head and the piston rod to prevent the piston head coming apart from the piston rod on which it is hinged while nevertheless allowing a certain amount of motion, thereby contributing to the degrees of freedom in translation and in rotation.

6. A rotary actuator device having an annular piston rod, the device comprising at least one piston head provided with sealing means and co-operating with an annular piston rod mounted so as to be capable of moving in an annular chamber, together with means for selectively applying a fluid under pressure in said annular chamber, wherein the piston head cooperates with the piston rod via a hinge having one degree of freedom in rotation and one degree of freedom in translation, said hinge comprising a piece in the form of a knife whose edge co-operates with a V-groove in a female portion of triangular profile, the knife edge and the V-groove being parallel to the axis of rotation of the piston rod;

said rotary actuator device comprising fastening means disposed between the piston head and the piston rod to prevent the piston head coming apart from the piston rod on which it is hinged while nevertheless allowing a certain amount of motion, thereby contributing to the degrees of freedom in translation and in rotation, wherein said fastening means comprises a pin passing through the knife and the female portion of triangular profile perpendicularly to said edge.

7. A rotary actuator device having an annular piston rod, the device comprising at least one piston head provided with sealing means and co-operating with an annular piston rod mounted so as to be capable of moving in an annular chamber, together with means for selectively applying fluid under pressure in said annular chamber, wherein the piston head cooperates with the piston rod via a hinge having one degree of freedom in rotation and one degree of freedom in translation, said hinge comprising a piece in the form of a knife whose edge co-operates with a V-groove in a female portion of triangular profile, the knife edge and the V-groove being parallel to the axis of rotation of the piston rod;

said rotary actuator device comprising fastening means disposed between the piston head and the piston rod to prevent the piston head coming apart from the piston rod on which it is hinged while nevertheless allowing a certain amount of motion, thereby contributing to the degrees of freedom in translation and in rotation, wherein said fastening means comprises at least one clip extending essentially perpendicularly to said knife edge, said clip being engaged in grooves formed in the knife and having curved ends themselves engaged in notches formed in the support of the female portion of the triangular profile.

8. A device according to claim 1, wherein said sealing means comprises a sealing gasket having spherical contact and whose radial stiffness is chosen as a function of the operating pressure applied in the annular chamber.

9. A device according to claim 1, wherein the sealing means comprises a gasket having a lip, a bead, and an expander providing automatic mechanical centering.

10. A device according to claim 1, wherein the sealing means comprises a gasket having a lip and a bead with said fluid pressure providing pneumatic stiffness.

11. A device according to claim 1, wherein said device constitutes a medium or high pressure pneumatic rotary actuator.

12. A device according to claim 1, wherein said device constitutes a medium or high pressure hydraulic rotary actuator.

* * * * *

UNITED STATES PATENT AND TRADEMARK OFFICE

CERTIFICATE OF CORRECTION

PATENT NO. : 5,235,900

DATED : August 17, 1993

INVENTOR(S) : Patrick Garceau

It is certified that error appears in the above-indentified patent and that said Letters Patent is hereby corrected as shown below:

Column 2, line 30, "above-described." should read --above-described phenomenon.--.

Column 3, line 11, "cryogen" should read --cryogenic--.

Column 6, line 67, "107 pascals" should read --$10^7$ pascals--.

Signed and Sealed this

Fifth Day of July, 1994

Bruce Lehman

*Attest:*

BRUCE LEHMAN

*Attesting Officer*

*Commissioner of Patents and Trademarks*